United States Patent [19]

Treadway

[11] Patent Number: 5,020,448

[45] Date of Patent: Jun. 4, 1991

[54] SHELF STRUCTURES FOR USE IN MOVING VEHICLES

[75] Inventor: Patrick P. Treadway, Ontario, Calif.

[73] Assignee: Minolta Camera Kabushiki Kaisha, Osaka, Japan

[21] Appl. No.: 397,018

[22] Filed: Aug. 22, 1989

[51] Int. Cl.[5] ..... A47B 23/00

[52] U.S. Cl. ..... 108/42; 312/320

[58] Field of Search ..... 108/3, 9, 44, 38, 26, 108/42, 61, 39; 211/42, 40, 41, 184; 312/311, 320, 233, 276

[56] References Cited

U.S. PATENT DOCUMENTS

| | | | |
|---|---|---|---|
| 407,009 | 7/1889 | Horwitz | 312/276 X |
| 510,459 | 12/1893 | Wilkinson | 312/276 X |
| 622,335 | 4/1899 | Eales | 312/320 X |
| 2,216,195 | 10/1940 | Hunter | 312/276 X |
| 2,405,668 | 8/1946 | Paxton et al. | 312/311 X |
| 2,516,116 | 7/1950 | Hammond | 312/311 X |
| 2,773,705 | 12/1956 | Hirak | 108/5 |
| 3,094,129 | 6/1963 | Wills | 211/40 X |
| 4,087,126 | 5/1978 | Wynn | 108/44 X |

FOREIGN PATENT DOCUMENTS

| | | | |
|---|---|---|---|
| 268946 | 7/1966 | Australia | 108/61 |

*Primary Examiner*—Jose V. Chen

*Attorney, Agent, or Firm*—Price, Gess & Ubell

[57] ABSTRACT

A shelf structure which is adapted to prevent articles from falling out of or off of a shelf in a moving vehicle can be constructed so as to use links to connect the shelf to a support or base in such a manner that the shelf can be moved between a storage and a exposed position by moving a handle connecting the links. In the storage position the shelf is held so that it is difficult or substantially impossible for an article to more or be moved off of it; in the exposed position the shelf is exposed so that an article can be easily placed on or removed from it. The shelf, the links and the support are constructed so that the shelf will not be stable in any position between the storage and exposed positions.

13 Claims, 2 Drawing Sheets

SHELF STRUCTURES FOR USE IN MOVING VEHICLES

BACKGROUND OF THE INVENTION

The invention set forth in this specification pertains to new and improved shelf structures. More specifically it pertains to shelf structures which are primarily intended to be used in moving vehicles such as motor homes but which can be otherwise used.

Normally shelf structures are constructed so as to utilize one or more supports which are adapted to rest on a floor or the like to be secured on a wall or in a housing or other cabinet and so as to utilize one or more horizontally extending shelves mounted on a support or supports so that normally there is no relative movement between the latter and the former. Such structures have used for centuries, are highly utilitarian and are universally used for all manner of purposes.

Unfortunately it is considered that such "normal" shelf structures are not overly desirable for use in some application in a moving vehicle such as a motor home, a travel trailer or the like because it is relative easy for any article placed on a shelf in such a shelf structure to slide off of it as the vehicle is operated. In may cases articles are retained on shelves in such vehicles by the use of various physical barriers such as doors, rails, elastic cords or the like. Such expedients are also highly utilitarian.

But it is considered that they are also they are some what undesirable in that they either have to be moved away from the front of a shelf to gain access to the shelf or in that they tend to hinder the placement of articles on shelves or the removal of articles from shelves. Further, in a few applications such expedients are undesirable in that they do not solve the problem of how to provide a shelf in an "out of the way" location such as a wall in a small room or area which can be easily positioned away from such a wall in order to facilitate access to the shelf.

While the latter problem can be solved by means such as specialized, movable mountings for a shelf such means do not solve the problem of retaining articles on shelves in an operating vehicle. It is normally undesirable to provide such a mounting means along with a specialized retainer or barrier serving to tend to hold articles on a shelf because of the cost and complexity of a shelf structure employing both of these types of expedients.

BRIEF SUMMARY OF THE INVENTION

From the preceding discussion it is believed that it will be apparent that there is a need for new and improved shelf structures, and, more specifically, for shelf structures which are primarily intended for use in various moving vehicles so as retain articles on such shelf structures from falling off of them as such vehicles are operated. The intention is intended to provide shelf structures which satisfy this need.

The invention is also intended to provide shelf structures, each of which is constructed so as to use a handle to manipulate a shelf within such a shelf structure between a storage position in which articles can only be located on or removed from the shelf with a degree of difficulty and an exposed position in which it is comparatively easy to locate articles on or remove articles from the shelf. With the present invention such a degree of difficult is normally great enough to prevent an article on shelf of a shelf structure of the invention from coming off of the shelf as a result of the vibration and other forces acting on the article as a vehicle is operated.

Although with the present invention the holding action achieved when a shelf is in a storage position can be solely the action of gravity alone or can be the result of the action of a barrier or barricade alone, but is preferably the result of the action of both. With the present invention both of such manners of holding articles on a shelf can be achieved by using a linkage to move the shelf through what can be regarded as a "over center" position. When the action or a barricade is desired this can be achieved by using a handle for moving the shelf and the linkage so that it blocks the front of the shelf.

From a consideration of the remainder of this specification and the accompanying drawings it will be apparent that an objective of the invention is to provide shelf structures as indicated in the prior discussion which can be easily manufactured at a comparatively nominal cost. Another objective is to provide shelf structures which may be easily installed. Further objectives of the invention are to provide shelf structures which are easily used, which require little or no maintenance event after being used for prolonged periods and which are adequately effective for their intended utilization.

In accordance with this invention these various objectives are achieved by providing a shelf structure having a shelf, support means for use in supporting said shelf so that said shelf extends substantially horizontally and connecting means for connecting said shelf to said support means, said connecting means connecting said shelf and said support means so that said shelf extends generally horizontally in which the improvement comprises:

said connecting means comprising link means extending between and connecting said said shelf and said support means, said link means being connected to said shelf and said support means so as to be rotatable with respect to both said shelf and said connecting means and so as to permit said shelf to be moved between a storage position and a normal use position by raising at least that portion of said shelf means connected to said link means to a height which is higher than the height of said portion in either of said positions as said shelf is moved between said positions, said support means including prop means for engaging said shelf in both of said positions so as to hold said shelf against movement other than movement between said positions and for preventing undesired tilting of said shelf as moved between said two positions, and handle means for use in moving said shelf between said two positions, said handle means being operatively associated with said shelf so that movement transmitted to said handle means will result in movement of said shelf.

BRIEF DESCRIPTION OF THE DRAWINGS

Because of the nature of the invention it is best more fully described by referring to the accompanying drawings in which.

Figure 1:
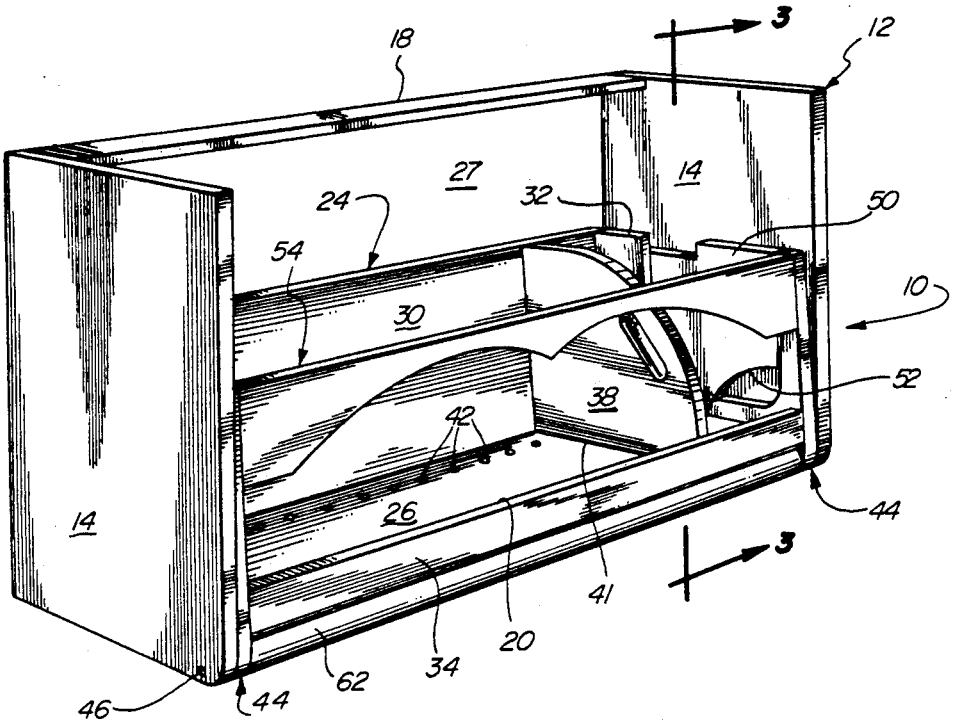
FIG. 1 is a perspective view of a presently preferred embodiment of form of a shelf structure of the present invention in which the shelf of the structure is in a closed or storage position.
Figure 2:
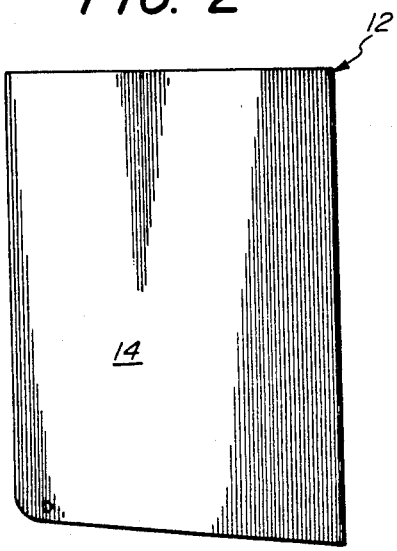
FIG. 2 is an end elevational view of the right end thereof.

The shelf structure illustrated in the drawing is constructed so as to utilize the operative concepts or principles of the invention set froth and defined in the appended claims forming a part of this specification. Those skilled in the field of the invention will realize that these concepts or principles can be easily incorporated into other, differently appearing and somewhat differently constructed shelf structures through the use or exercise of routine design skill. Thus, for example, although the precise shelf structure shown is designed and constructed so as to be used as a bookshelf it could be easily modified so as to serve to hold groceries or other articles. Because of the considerations as set forth in this paragraph the invention is not to be considered as being limited by the drawings, but instead is to be considered as being limited solely by the appended claims.

DETAILED DESCRRIPTION OF THE PREFERRED EMBODIMENT

In the drawings there is a shown a shelf structure 10 in accordance with the present invention which is constructed so as to use a housing 12 as a "support means." This housing 12 includes parallel ends 14 connected by a rearwardly sloping base or bottom 16 and back braces 18. As will be apparent from this the housing 12 has an open front 20 and a largely open back 22. If desired the back 22 could be enclosed, but this is not usually necessary when the structure 10 is employed in a location generally at the intersection of the roof (not shown) and a side wall (not shown) of a vehicle (not shown) such as a motor home or a travel trailer.

The shelf structure 10 also includes a shelf 24 which is constructed so as to have a bottom 26 having ends 28, a back 30 connected to the bottom 26 along the entire length of the bottom 26 and parallel end panels 32. As a practical matter these ends 28 can be consider to be the ends of the shelf 24. In addition the shelf 24 may include additional features such as a small front lip 34 on the bottom 26 which is designed to prevent articles such as books 36 from directly sliding off of the bottom 26 or such as a adjustable stop 38. This stop 38 is of a conventional category and is adapted to be portioned so that pins 40 on its bottom 41 interlock with various holes 42 in the bottom 26 so as to prevent the books 36 from falling over when the structure 10 is used.

Figure 3:
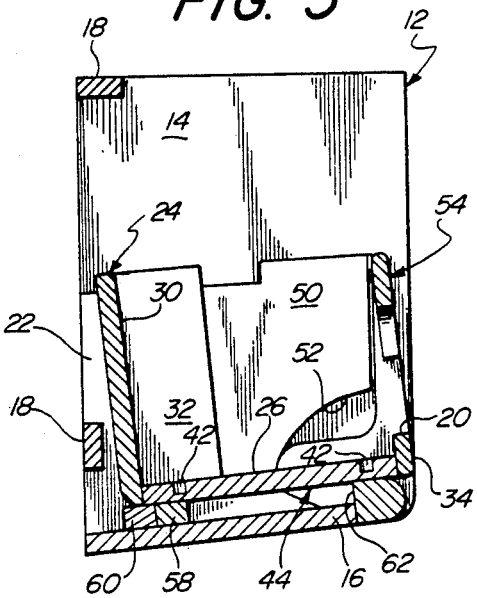
FIG. 3 is a cross-sectional view taken at line 3—3 of FIG. 1.

In order to position the shelf 24 small more or less bell crank shaped, identical links 44 are pivotally connected to the the ends 14 by conventional pivots 46. These links 44 are also connected to the ends 28 of bottom 26 of the shelf 24 by other conventional pivots 48. With the particular structure 10 illustrated optional spacers 50 may be located generally between the shelf 24 and the end 14 so as to tend to prevent lengthwise shifting. If used these spacers 50 should include notches 52 to accommodate movement of the links 44. These links 44 are preferably connected together by a handle 54 which extends parallel to the shelf 24 so as to tend to serve a a barricade or barrier enclosing the normally open front 56 of the shelf 24 when this shelf is in a closed or storage position as indicated in FIGS. 1 and 3.

Figures 4, 5, 6, 7:
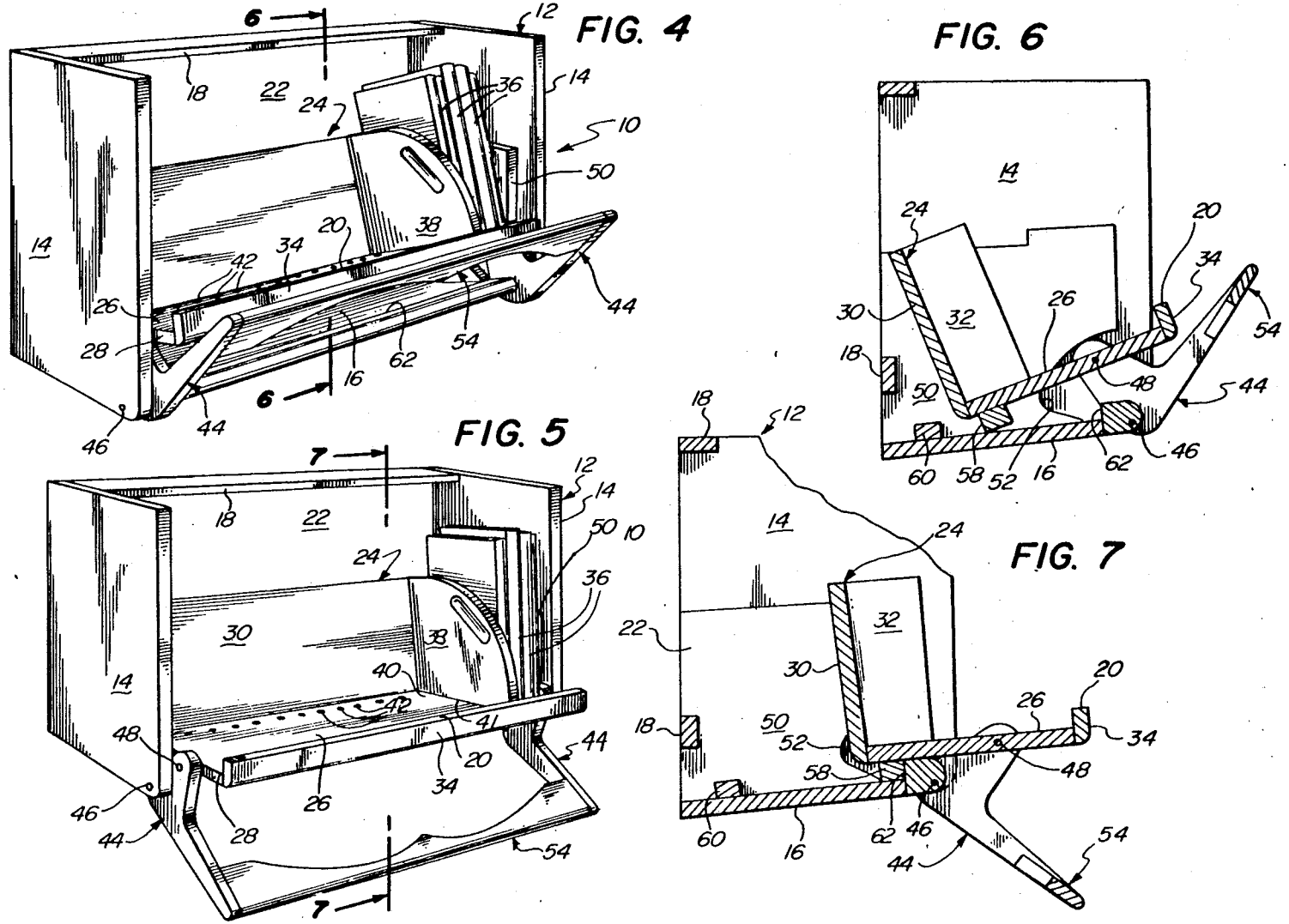
FIG. 4 is a perspective view similar to FIG. 1 in which the shelf structure is shown as it appears while the shelf in it is being moved from the closed or storage position.
FIG. 5 is a perspective view similar to FIGS. 1 and 4 in which the shelf structure is shown when in an open or exposed position.
FIG. 6 is a cross-sectional view taken at line 6—6 of FIG. 4.
FIG. 7 is a cross-sectional view taken at line 7—7 of FIG. 5.

In this position the handle 54 will serve to retain the books 36 or any other comparative large articles on the shelf 24 as a vehicle (not shown) upon which the structure 10 is mounted moves. When it is desired to gain access to the books or such other articles—preferably, but not necessarily after such a vehicle has stopped—the handle 54 may be engaged and rotated to an open or exposed position as shown in FIGS. 5 and 7. During such movement the shelf 24 will be moved so that an elongated bar 58 on the bottom 26 of the shelf 24 slides along the bottom 16 from against a rear stop 60 on the bottom 16 to against a front stop 62 which is also on the bottom 16.

During such movement the bottom 16 of the housing 12 supports or props up the bar 58 and the remainder of the shelf 24 generally at or adjacent to the back 30 of the shelf 24 regardless of the position of the pivots 48 and the shelf 24. Because of this the bottom 16 can be termed a "prop" or a "prop means" since it serves to prop up or maintain the level of the shelf 24 adjacent to the back 30. During such movement of the bar 58 along the bottom 16 those portions of the shelf 24 generally adjacent to the pivots 48 are elevated as the links 44 are rotated by movement of the handle 54 through what may be considered as an "over center" position.

This is because of the fact that the pivots 48 pass through positions which are vertically directly above the pivots 46 as the handle 54 is manipulated. With this construction the pivots 48 are as far downwardly as then can get when the shelf 24 is in either the storage or the exposed position because of the action of the bar 58 hitting against either the stop 60 or the stop 62. Hence, the position of the shelf 24 is only stable when the shelf 24 is either of these two positions. The "action" involved in achieving such two positions of stability is related to that of a common overcenter toggle but differs from a true toggle action in that gravity holds the shelf 24 in either of the two positions of stability described whereas in a conventional toggle a mechanically derived biasing force is used for the same purpose.

Because of the latter if desired it can be considered that the action achieved with the invention in holding a shelf is either of two positions as described is a toggle action. If desired the bar 58 and the stops 60 and 62 can be considered as means for limiting both the ration of the links 44 and movement of the shelf 24. Also, if desired the bottom 16 can be considered as a means for preventing undesired tilting of the shelf 24 because it maintains the height of the bar 58 and adjacent portions of the shelf 24 as the shelf is rotated relative to the bar 58 as a result of the movement imparted to it through the pivots 48.

As a result of the slope of the bottom 16, and the location and dimensions of the bar 58 and the stops 60 and 62 and other constructional details the bottom 26 of the shelf 24 always slopes at least slightly toward the back 30 of the shelf 24. This alone will tend to retain items such as the books 36 from coming off of the shelf 24 as a vehicle is moved. However, because of its location when the shelf 24 is is a storage position the handle alone normally serves as an adequate retainer for whatever may be on the shelf 24.

I claim:

1. A shelf structure comprising:

a shelf having a bottom and first and second vertically extending parallel end panels located at opposite ends of said bottom;

a support means for receiving, containing, and supporting said shelf and including first and second sides having a front, rear, top and bottom edge, a back, an open front, and a bottom; and first and second bell-shaped links, being pivotally mounted to a respective one of said first and second sides of said support means at respective first and second pivot points thereon, said first and second pivot points substantially at said front and bottom edges of said first and second sides, said bell-links being C shaped further pivotally mounted at respective third and fourth pivot points thereon to said shelf for moving said shelf outwardly away from and in front of said support means as said first and second links pivot about the respective first and second pivot points in a first direction and inwardly toward said support means as said first and second links pivot about said first and second pivot points in a second direction to provide a toggle movement.

2. The shelf structure of claim 1 wherein the bottom of said support means slopes upwards from said back to said front.

3. The shelf structure of claim 2 further including second stop means for stopping movement of said shelf toward said support means.

4. The shelf structure of claim 1 further including first stop means for stopping the outward movement of said shelf away from said support means.

5.The shelf structure of claim 1 further comprising:

first and second horizontal stop means affixed to the top surface of the bottom of said support means; and a horizontal stop means affixed to the underside of the bottom of said shelf for abutting said first stop means after a selected amount of movement about said first and second pivot points in said first direction and for abutting said second stop means after a selected amount of movement about said first and second pivot point in said second direction.

6. The shelf structure of claim 1 wherein said third and fourth pivot points are located so as to pass over said first and second pivot points as said shelf moves outwardly.

7. The shelf structure of claim 6 wherein said first, second, third, and fourth pivot points are positioned such that said shelf initially tilts upward and then back downward as said shelf moves outwardly.

8. The shelf structure of claim 7 further including a handle means connecting said first and second link means for pulling said first and second link means and said shelf outwardly.

9. The shelf structure of claim 8 wherein said handle means is further positioned so as to form a barrier to the outward passage of objects stored on said shelf.

10. The shelf structure of claim 9 further comprising:

first and second horizontal stop means affixed to the top surface of the bottom of said support means;

a horizontal stop means affixed to the underside of the bottom of said shelf for abutting said first stop means after a selected amount of movement about the first and second pivot points in said first direction and for abutting said second stop means after a selected amount of movement about said first and second pivot points in said second direction; and wherein said horizontal stop means further functions to prop said shelf against said bottom during said outward movement.

11. A shelf structure comprising:

a shelf having a bottom and first and second vertically extending parallel end panels located at opposite ends of said bottom;

a support means for receiving, containing, and supporting said shelf and including first and second sides having a front, rear, top, and bottom edge, a back, an open front, and a bottom first and second bell-shaped link members, being pivotally mounted to a respective one of said first and second sides of said support means at respective first and second pivot points thereon, said first and second pivot points substantially at said front and bottom edges of said first and second sides said bell-shaped link members being further pivotally mounted at respective third and fourth pivot points thereon to said shelf for moving said shelf outwardly away from and in front of said support means as said first and second link members pivot about the respective first and second pivot points in a first direction and inwardly toward said support means as said first and second link members pivot about said first and second pivot points in a second direction; and wherein said third and fourth pivot points are located so as to pass over said first and second pivot points as said shelf moves outwardly to provide a toggle movement.

12. The shelf structure of claim 11 wherein said first, second, third, and fourth pivot points are positioned such that said shelf initially tilts upward and then back downward as said shelf moves outwardly.

13. A shelf structure comprising:

a shelf having a bottom and first and second vertically extending parallel end panels located at opposite ends of said bottom;

a support means for receiving, containing, and supporting said shelf and including first and second sides having a front rear, top, and bottom edge, a back, an open front, and a bottom sloping upwards from back to front;

first and second substantially bell-crank-shaped link members, being pivotally mounted to a respective one of said first and second sides of said support means at respective first and second pivot points thereon, said first and second pivot points substantially at said front and bottom edges of said first and second sides said bell-shaped link members being further pivotally mounted at respective third and fourth pivot points thereon to said shelf for moving said shelf outwardly away from and in front of said support means as said first and second link members pivot about the respective first and second pivot points in a first direction and inwardly toward said support means as said links pivot about said first and second pivot points in a second direction, said third and fourth pivot points being located so as to pass over said first and second pivot points as said shelf moves outwardly and such that said shelf initially tilts upward and then back downward as said shelf moves outwardly to provide a toggle movement;

first and second horizontal stop means affixed to the top surface of the bottom of said support means;

a horizontal stop means affixed to the underside of the bottom of said shelf for abutting said first stop means after a selected amount of movement about the first and second pivot points in said first direction and for abutting said second stop means after a selected amount of movement about said first and second pivot points in said second direction; and handle means connecting said first and second link members for pulling said links and said shelf outwardly, said handle means being positioned so as to form a barrier to the outward passage of objects stored on said shelf.

* * * * *

UNITED STATES PATENT AND TRADEMARK OFFICE

CERTIFICATE OF CORRECTION

PATENT NO. : 5,020,448

DATED : June 4, 1991

INVENTOR(S) : Patrick P. Treadway

It is certified that error appears in the above-identified patent and that said Letters Patent is hereby corrected as shown below:

On the title page item:

[73] Assignee: delete "Minolta Camera Kabushiki Kaisha, Osaka, Japan" and insert --Fleetwood Enterprises, Inc., Riverside, California--.

Signed and Sealed this

Twenty-third Day of March, 1993

*Attest:*

STEPHEN G. KUNIN

*Attesting Officer*

*Acting Commissioner of Patents and Trademarks*